US006470854B1

(12) United States Patent
Hirata et al.

(10) Patent No.: US 6,470,854 B1
(45) Date of Patent: Oct. 29, 2002

(54) AIR-FUEL RATIO CONTROL WITH IMPROVED FUEL SUPPLY OPERATION IMMEDIATELY AFTER COMPLETE COMBUSTION OF MIXTURE

(75) Inventors: Yasuo Hirata, Obu; Hidehiko Asama, Toyota, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/587,368

(22) Filed: Jun. 2, 2000

(30) Foreign Application Priority Data

Jul. 21, 1999 (JP) ..... 11-205759

(51) Int. Cl.[7] ..... F02M 7/00

(52) U.S. Cl. ..... 123/436; 123/704; 701/103; 701/110

(58) Field of Search ..... 123/295, 339.12, 123/339.19, 339.22, 339.24, 436, 704, 443, 491, 492, 493, 494; 701/103, 110, 113

(56) References Cited

U.S. PATENT DOCUMENTS 4,442,815 A * 4/1984 Ninomiya ..... 123/436
4,479,476 A * 10/1984 Suzuki et al. ..... 123/478
5,462,039 A * 10/1995 Mamiya et al. ..... 123/686
5,564,387 A * 10/1996 Igarashi et al. ..... 123/339.23
5,697,337 A * 12/1997 Takahashi et al. ..... 123/339.11
5,758,632 A * 6/1998 Yamashita et al. ..... 123/688
5,878,711 A * 3/1999 Kamura et al. ..... 123/295
5,975,044 A * 11/1999 Kamura et al. ..... 123/295
6,209,517 B1 * 4/2001 Yasui ..... 123/339.11
6,212,879 B1 * 4/2001 Nishimura et al. ..... 60/274
6,223,730 B1 * 5/2001 Hasegawa et al. ..... 123/491
6,227,163 B1 * 5/2001 Enoki et al. ..... 123/295

FOREIGN PATENT DOCUMENTS

JP 60-3440 1/1985
JP 232141 * 9/1989 ..... F02D/41/14
JP 137242 * 5/1994 ..... F02P/5/15
JP 166934 * 6/1995 ..... F02D/41/14
JP 7-189768 7/1995

* cited by examiner

*Primary Examiner*—Tony M. Argenbright
*Assistant Examiner*—Hai Huynh
(74) *Attorney, Agent, or Firm*—Nixon & Vanderhye P.C.

(57) ABSTRACT

In an air fuel ratio control for engines, a target operation characteristic of engine speed is set based on a coolant temperature when the engine starts cranking. The target engine speed is variable with time after the engine cranking has started and converges to a speed value lower than a normal target idle speed. Immediately after a complete combustion of air-fuel mixture suplied to the engine is detected, an actual engine speed is compared with a target engine speed corresponding to the target operation characteristics, and an air-fuel ratio of the mixture supplied to the engine is controlled based on a comparison result.

27 Claims, 9 Drawing Sheets

AIR-FUEL RATIO CONTROL WITH IMPROVED FUEL SUPPLY OPERATION IMMEDIATELY AFTER COMPLETE COMBUSTION OF MIXTURE

CROSS REFERENCE TO RELATED APPLICATION

This application relates to and incorporates herein by reference Japanese Patent Application No. 11-205759 filed on Jul. 21, 1999.

BACKGROUND OF THE INVENTION

1. Field of the Invention

The present invention relates to an air-fuel ratio control for engines which improves air-fuel mixture supply immediately after completion of mixture combustion for engine starting.

2. Related Art

Conventional engine control systems have a catalytic converter in an exhaust pipe to purify exhaust emissions, and feedback-controls an air-fuel ratio of air-fuel mixture to a stoichiometric ratio in response to the air-fuel ratio detected by an air-fuel ratio sensor. The feedback control is disabled until engine temperature sufficiently rises as disclosed in JP-A-60-3440, because the air-fuel ratio sensor is not operative under low temperatures. Therefore, the feedback control is disabled during an engine starting (cranking by a starter motor) period and a post-starting period.

Further, immediately after the complete combustion of air-fuel mixture in those starting and post-starting periods, the engine rotation speed quickly rises and then falls, thus presenting irregular rotation speed changes. If less-volatile heavy fuel is supplied to the engine, the fuel is likely to remain sticking to intake port walls of the engine during low temperature conditions, thus leaning the air-fuel mixture supplied to the engine. The engine may misfire and stall immediately after engine starting.

SUMMARY OF THE INVENTION

It is therefore an object of the present invention to provide an air-fuel ratio control for engines which controls an air-fuel mixture ratio appropriately immediately after a complete mixture combustion in an engine starting operation.

According to the present invention, a target operation characteristics of engine speed is set based on a coolant temperature at the time of starting an engine cranking. The target engine speed is variable with time after starting engine cranking. Immediately after a complete combustion of air-fuel mixture supplied to the engine is detected, an actual engine speed is compared with a target engine speed corresponding to the target operation characteristics, and an air-fuel ratio of mixture supplied to the engine is controlled based on a comparison result. Thus, the air-fuel ratio control is effected immediately after the complete combustion of air-fuel mixture, even when an air-fuel ratio sensor is inoperative to effect an air-fuel ratio feedback control.

Preferably, the target engine speed is determined to converge to a speed value lower than a normal target idle speed, and the air-fuel ratio control based on the comparison result prevails an engine idle speed feedback control. The air-fuel ratio control is effected by using a first correction value calculated as a function of a difference between the target speed and the actual speed, and a second correction value calculated as a function of a difference between the target speed and an estimated future speed estimated from air flow amount. The air-fuel ratio control is further effected by using a combustion unstableness value.

BRIEF DESCRIPTION OF THE DRAWINGS

Other objects, features and advantages of the present invention will become more apparent from the following detailed description made with reference to the accompanying drawings. In the drawings.

DETAILED DESCRIPTION OF THE PREFERRED EMBODIMENTS

Figure 1:
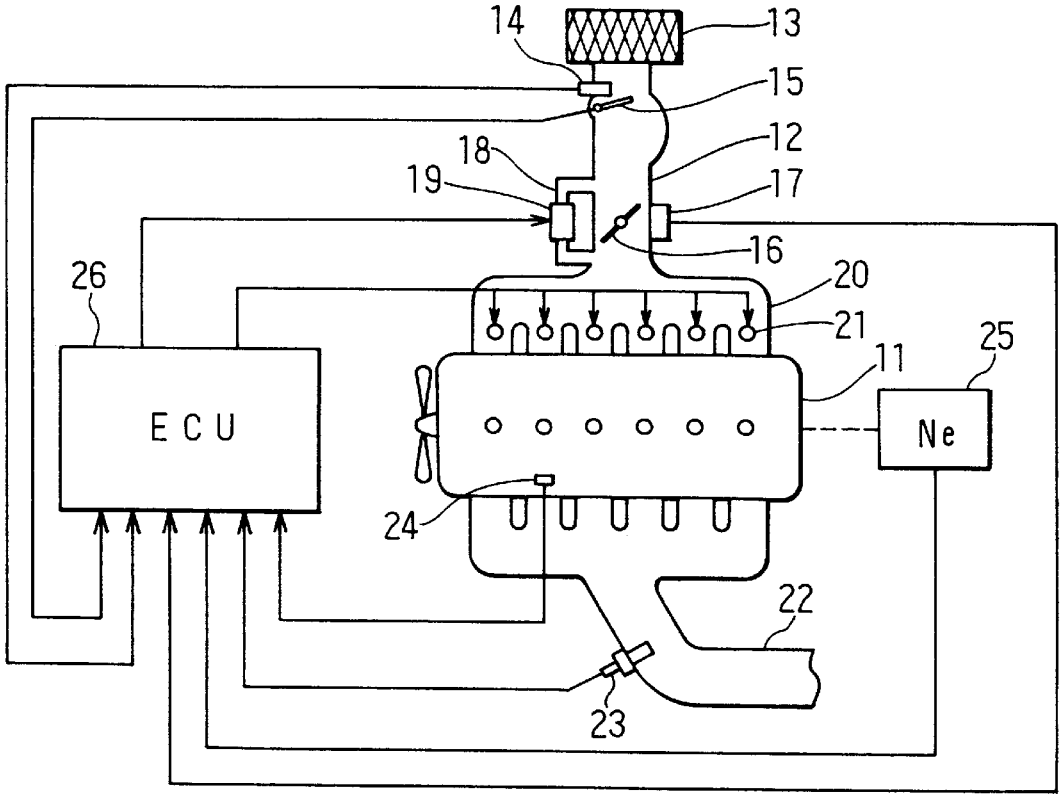
FIG. 1 is a schematic view showing an air-fuel ratio control system according to an embodiment of the present invention.

Referring first to FIG. 1 showing an entire control system, an internal combustion engine 11 has an intake pipe 12 including an air filter 3 at its most upstream side. An intake air temperature sensor 14 and an intake air flow meter 15 are provided downstream the air cleaner 14 for sensing the intake air temperature THA and the intake air flow amount Gn, respectively. A throttle valve 16 and a throttle angle sensor 17 for sensing the throttle angle (throttle opening position) TA are provided downstream the air flow meter 15.

A bypass air passage 18 is connected to the intake pipe 12 in a manner to bypass the throttle valve 16. The bypass air passage 18 bypasses a part of the intake air to flow from the upstream to the downstream of the throttle valve 16. An idle speed control (ISC) valve 19 is provided in the bypass passage 18 to control the engine idle speed by regulating the bypass air flow amount. Fuel injectors 21 are mounted on intake manifolds 20 connecting the cylinders of the engine 11 and the intake pipe 12 to supply fuel to the corresponding cylinders, respectively.

The engine 11 also has an exhaust pipe 22. An air-fuel ratio sensor 23 is mounted on the exhaust pipe 22 for sensing the air-fuel ratio (A/F) of mixture supplied to the engine 11. The air-fuel ratio sensor 23 produces an air-fuel ratio signal which linearly or stepwisely changes with the oxygen concentration in the exhaust emissions. Although not shown in the figure, a three-way catalytic converter is mounted on the exhaust pipe 22 at the downstream side of the air-fuel ratio sensor 23 to purify harmful gas components (CO, HC, NOx and the like).

A coolant water temperature sensor 24 and a rotation sensor 25 are also mounted on the engine 11 to sense the coolant water temperature THW and the engine rotation speed Ne, respectively. The sensors 4, 5 17, 23, 24 and 25 are connected to an electronic engine control unit (ECU) 26, which controls the ISC valve 18, injectors 21 and the like in response to detection signals applied from the above sensors.

Figure 2:
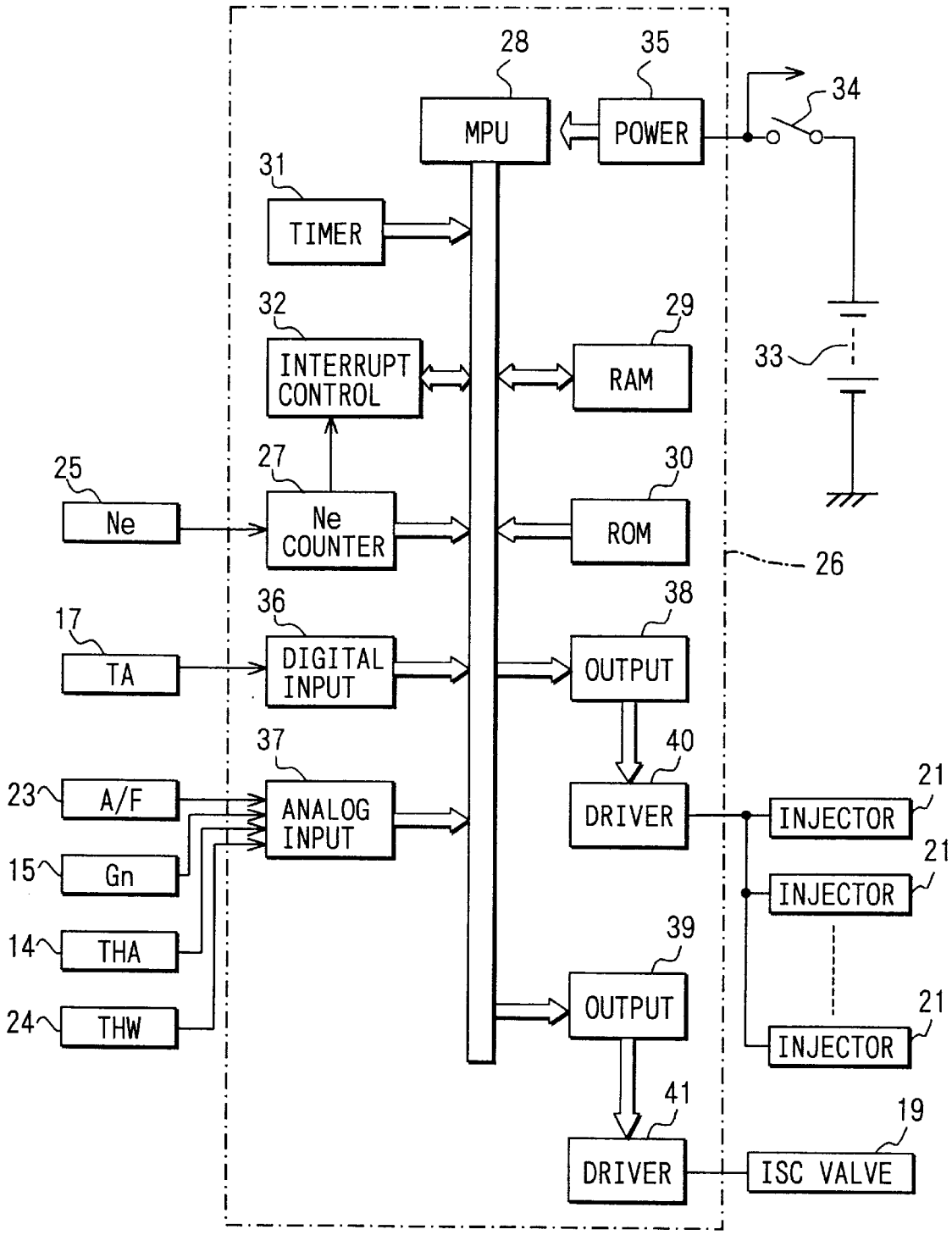
FIG. 2 is a block diagram showing an electrical construction of the control system shown in FIG. 1.

As shown in FIG. 2, the engine control unit 26 is primarily comprised of a microcomputer which includes a micro processing unit (MPU) 28, a random access memory (RAM) 29, a read-only memory (ROM) 30, a timer 31 and the like. The ECU 26 also is comprised of a rotation counter 27, an interrupt control circuit 32 and a power circuit 35. The interrupt control circuit 32 generates interrupt signals for initiating interrupt routines in response to a rotation detection signal from the rotation counter 27. The power unit 35 is connected to a storage battery 33 of a vehicle through an ignition switch 34. The ECU 26 is further comprised of a digital input circuit 36 and an analog input circuit 37, which apply the detection signals of the sensors 17, 114, 15, 24 and 23 to the MPU 28 therethrough, respectively.

These detection signals are used by the MPU 28 to calculate the fuel injection amount, the ISC valve position and the like for controlling the air-fuel ratio of mixture and the engine idle speed. The ECU 26 is still further comprised of output circuits 38 and 39 as well as driver circuits 40 and 41 to produce control signals and drive the fuel injectors 21 and the ISC valve 19 based on the calculation results of the MPU 28.

Figure 4:
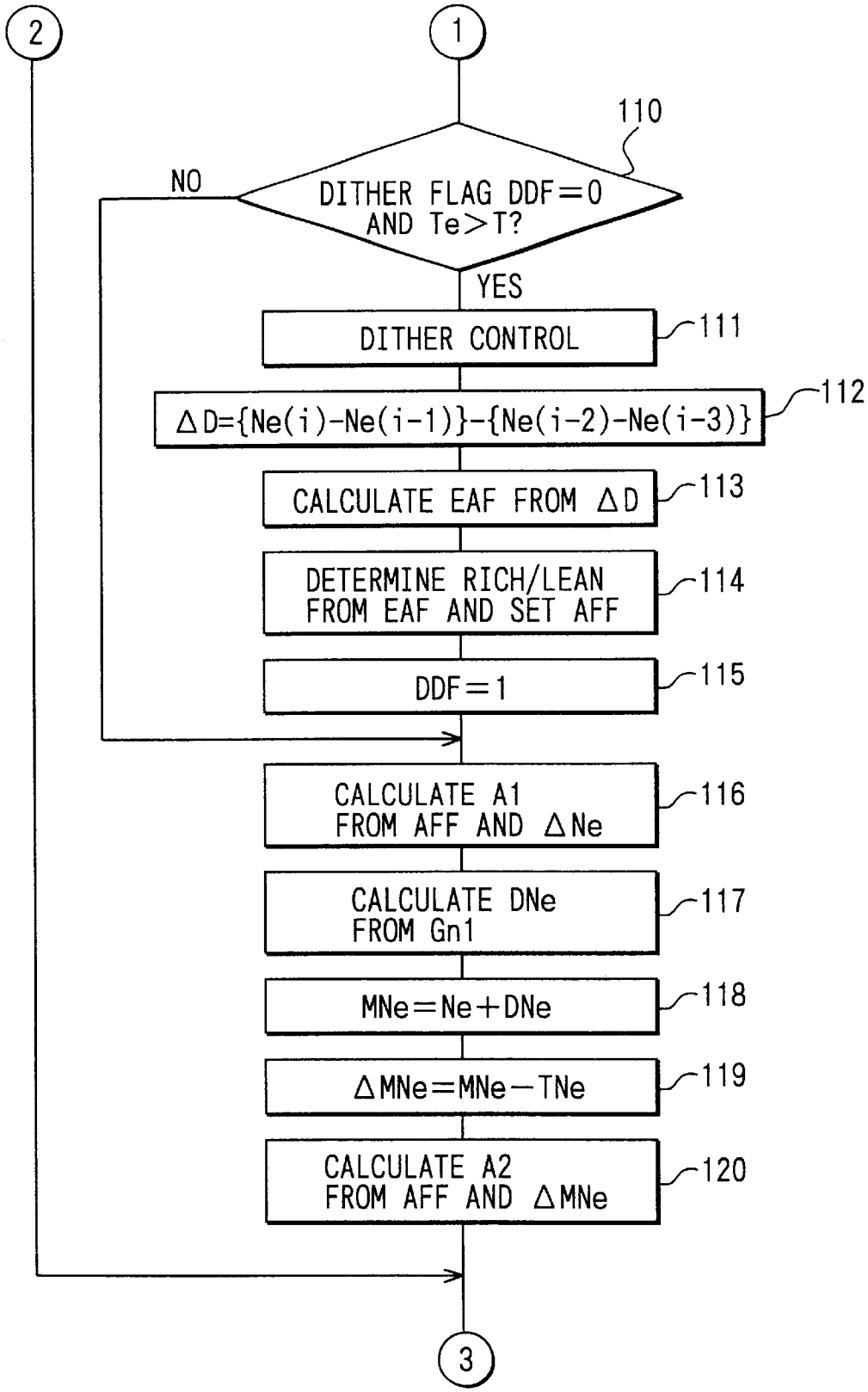
FIG. 4 is a flow diagram showing a second part of processing of the air-fuel ratio control program executed immediately after the completion of air-fuel mixture combustion.
Figure 5:
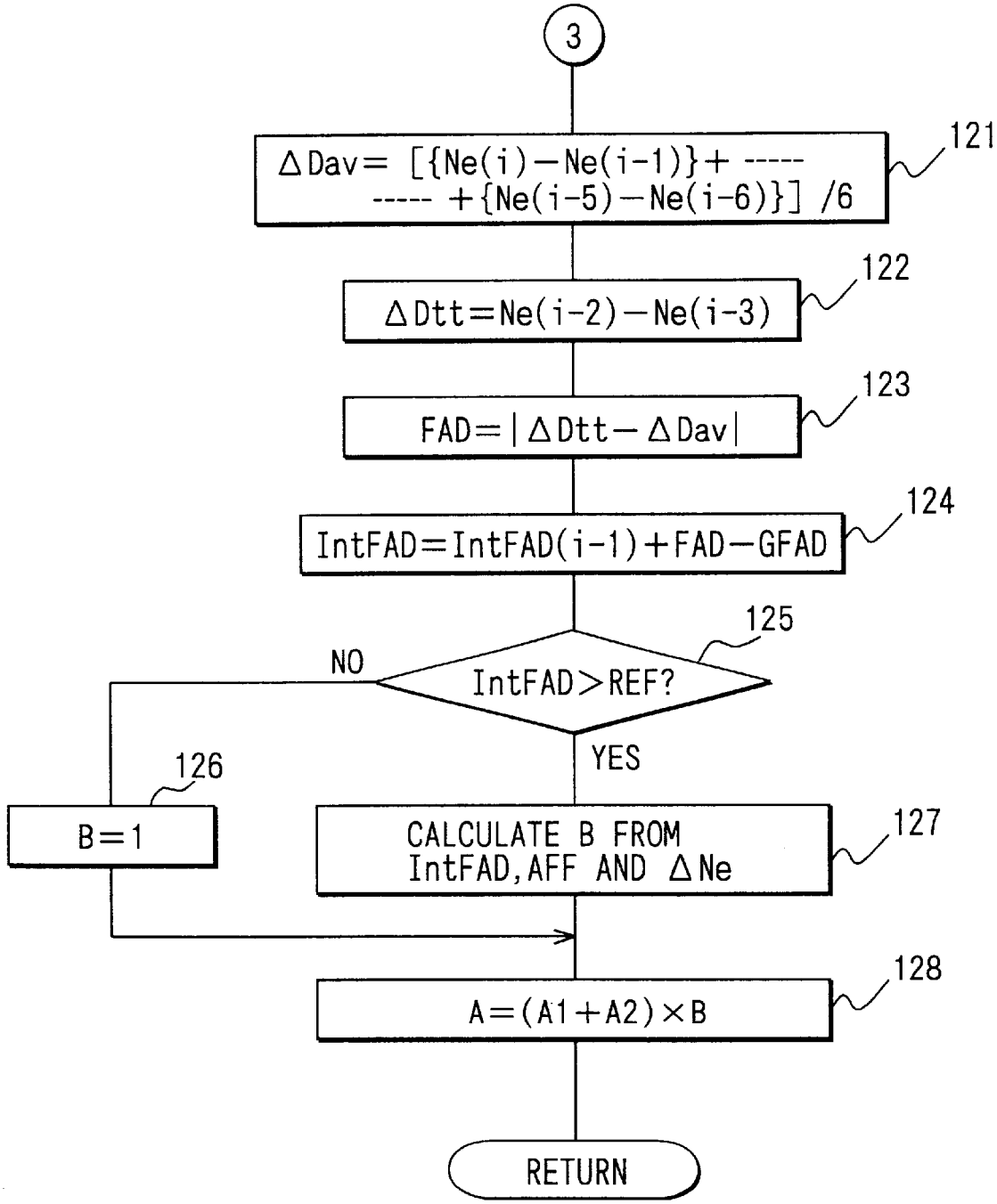
FIG. 5 is a flow diagram showing a third part of processing of the air-fuel ratio control program executed immediately after the completion of air-fuel mixture combustion.

The ECU 26, specifically the MPU 28, is programmed to control the fuel injection from the fuel injectors 21, the engine idle speed by the ISC valve 19 and the like based on the detected engine operating conditions. Particularly, the MPU 28 is programmed to control the fuel injection amount (air-fuel ratio) by executing a post-complete combustion air-fuel ratio control program shown in FIGS. 3 to 5, so that the engine rotation follows a predetermined rotation characteristics immediately after the complete combustion of the air-fuel mixture for engine starting. The MPU 28 initiates its programmed processing shown in FIGS. 3 to 5 every ignition of air-fuel mixture, that is, every 120° angular rotation of an engine crankshaft in the case six-cylinder engine.

Figure 3:
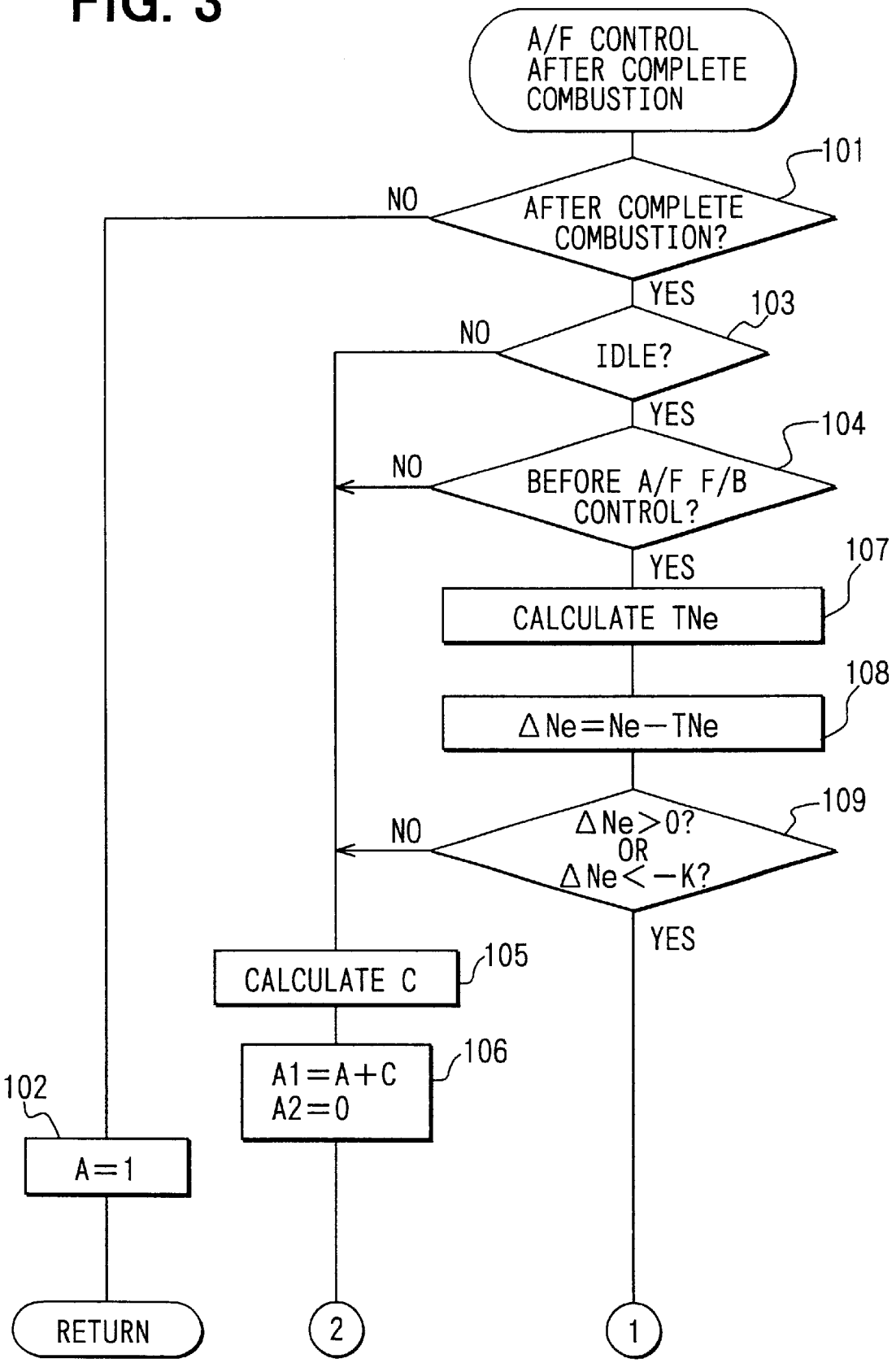
FIG. 3 is a flow diagram showing a first part of processing of an air-fuel ratio control program executed immediately after the completion of air-fuel mixture combustion.

As shown in FIG. 3, the MPU 28 first checks at step 101 whether it is after the complete combustion of the mixture for engine starting. The complete combustion may be detected by comparing the engine rotation speed Ne rises above a predetermined reference rotation speed (e.g., 250–400 rpm). If the check result is NO indicating that it is before the complete combustion, the MPU 28 sets at step 102 a fuel injection correction value A to 1 indicating no correction. In this instance, the post-complete combustion air-fuel ratio control is not effected but normal air-fuel ratio control is effected.

If the check result at step 101 is YES indicating the complete combustion, the MPU 28 checks at steps 103 and 104 whether the engine 11 is in a predetermined condition required to execute the post-complete combustion air-fuel ratio control. The required condition includes that the engine 11 is in the idle state (step 103), that is, the vehicle is at rest and the throttle valve 16 is fully closed, and that it is before an air-fuel ratio feedback control (step 104).

If the check result at either step 103 or 104 is NO, the MPU 28 calculates a gradual change value C at step 105, and calculate a first fuel injection correction value A1 by adding the gradual change value C to the fuel correction value A at step 106. The MPU 28 also sets a second fuel injection correction value A2 to 0. Thus, as long as the engine 11 is not in the predetermined condition for the post-complete combustion air-fuel ratio control condition, the gradual change value C is gradually changed so that the fuel injection correction value A gradually approaches 1 (no fuel injection correction).

If the check results at steps 103 and 104 are YES indicating the post-complete combustion air-fuel ratio control condition, the MPU 28 calculates a target engine rotation speed TNe at step 107 by a mapped data retrieval or mathematical calculation. The target speed TNe is calculated as a function of an engine operation duration Te after the complete combustion and the coolant temperature THW at the time of engine starting.

Here, the engine speed change characteristics, which will appear when the mixture supplied to the engine 11 is appropriately controlled after the complete combustion of mixture, is determined through experiments or simulations. This characteristics is stored in the ROM 30 as the characteristics of the target engine speed TNe. The target speed TNe in the change characteristics is determined to converge to a value which is lower than a target engine idle speed INe used in a normal engine idle speed control shown in FIG. 6.

The target engine speed TNe may also be calculated in consideration of the duration of engine rest before engine starting in addition to the coolant temperature at the time of engine starting. This is because, if the duration of the engine rest is comparatively short, the engine rest duration will influence the temperatures of the engine 11, the air-fuel ratio sensor 23 and the catalytic converter. In addition, the change characteristics of the target engine speed TNe may be calculated in further consideration of mechanical loads to an air conditioner and a torque converter as well as electrical loads.

After the above calculation of the target speed TNe at step 107, the MPU 28 calculates a difference ΔNe between the detected actual engine speed Ne and the target engine speed TNe as follows.

$$\Delta N\ e = Ne - TNe$$

The MPU 28 then checks at step 109 whether the air-fuel ratio of mixture after the complete combustion of mixture should be corrected. This check may be made by checking whether the difference is larger than 0 (ΔNe>0) or smaller then a negative reference (ΔNe<−K). The reference (−K) may be determined as a function of the intake air amount Gn and the engine speed Ne.

If the check result at step 109 is NO (0>ΔNe>−K) indicating that the actual rotation speed Ne is equal to or only lower than the target speed TNe, the MPU 28 determines that no correction of air-fuel ratio of mixture should be made, and executes the above steps 105 and 106 to gradually change the fuel injection correction value A to 1. If the check result at step 109 is YES (ΔNe>0 or ΔNe<−K), on the other hand, the MPU 28 determines that the fuel injection correction should be made. That is, if the engine speed Ne is higher than the target speed TNe, the air-fuel ratio is considered to be rich and should be corrected to the leaner side. If the engine speed Ne is lower than the target speed TNe and the absolute value of the difference |ΔNe| is larger than K, the air-fuel ratio is considered to be too lean and should be corrected to the much richer side so that misfire should not occur due to too lean air-fuel mixture.

When the fuel injection should be corrected (YES at step 109), the MPU 28 checks at step 110 whether an injection dither control is to be effected. Here, it checks whether an injection dither execution flag DFF is 0 indicating non-execution of the injection dither control and whether the engine operation duration Te after the complete combustion of mixture is in excess of a predetermined duration T. The dither execution flag DFF is reset to 0 when the MPU 28 is initialized at the time of starting power supply from the power circuit 28.

The predetermined duration T, which indicates a timing to start dithering the fuel injection, may be determined by a mapped data retrieval or mathematical calculation. It may preferably be determined as a function of the coolant temperature THW of the engine 11, because the change characteristics of the target engine speed TNe differs in dependence on the coolant temperature THW at engine starting.

Figure 7:
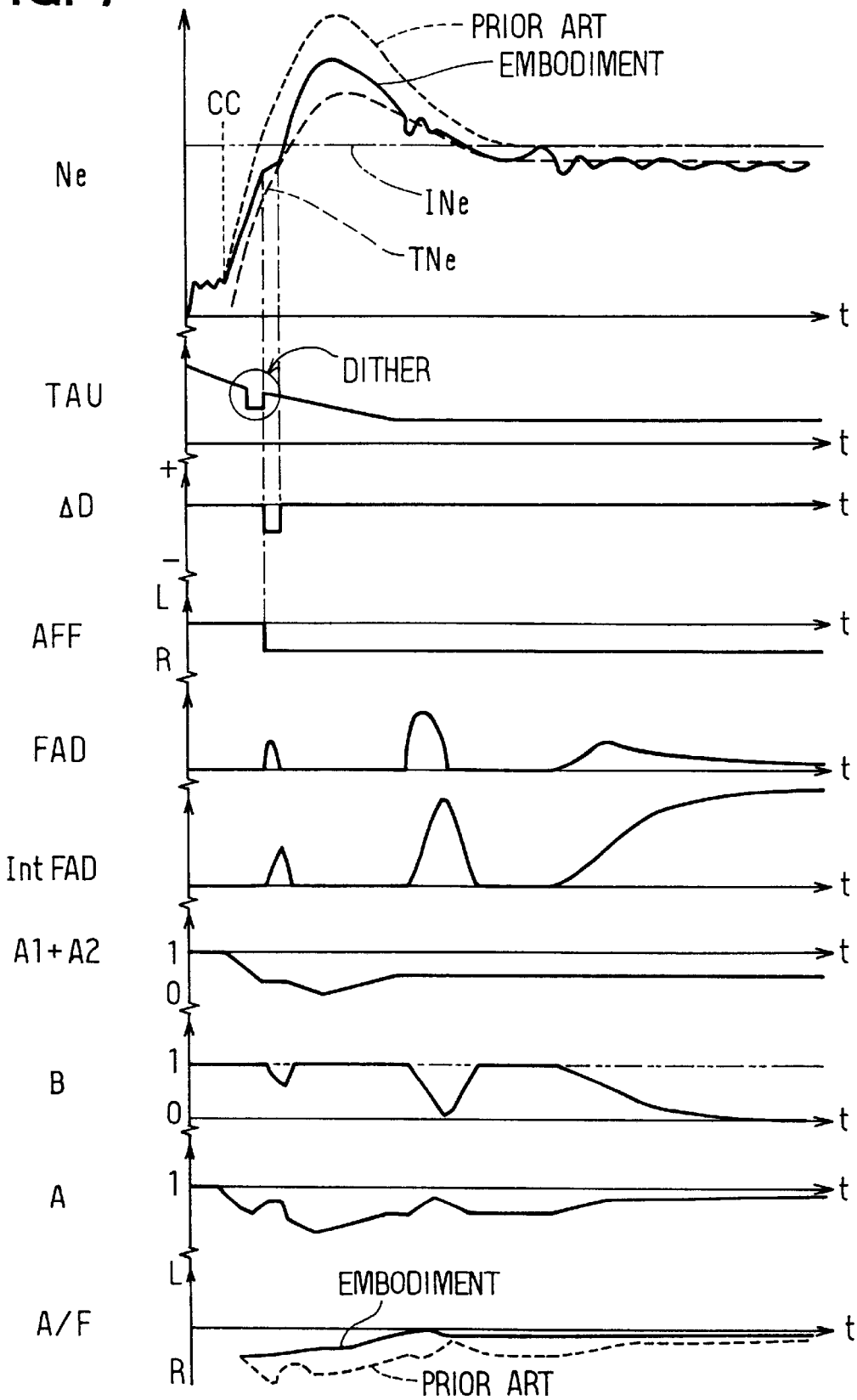
FIG. 7 is a timing diagram showing an operation of the air-fuel ratio control system when an air-fuel ratio of mixture supplied to the engine immediately after the complete combustion is rich and the engine rotation speed rises high.
Figure 8:
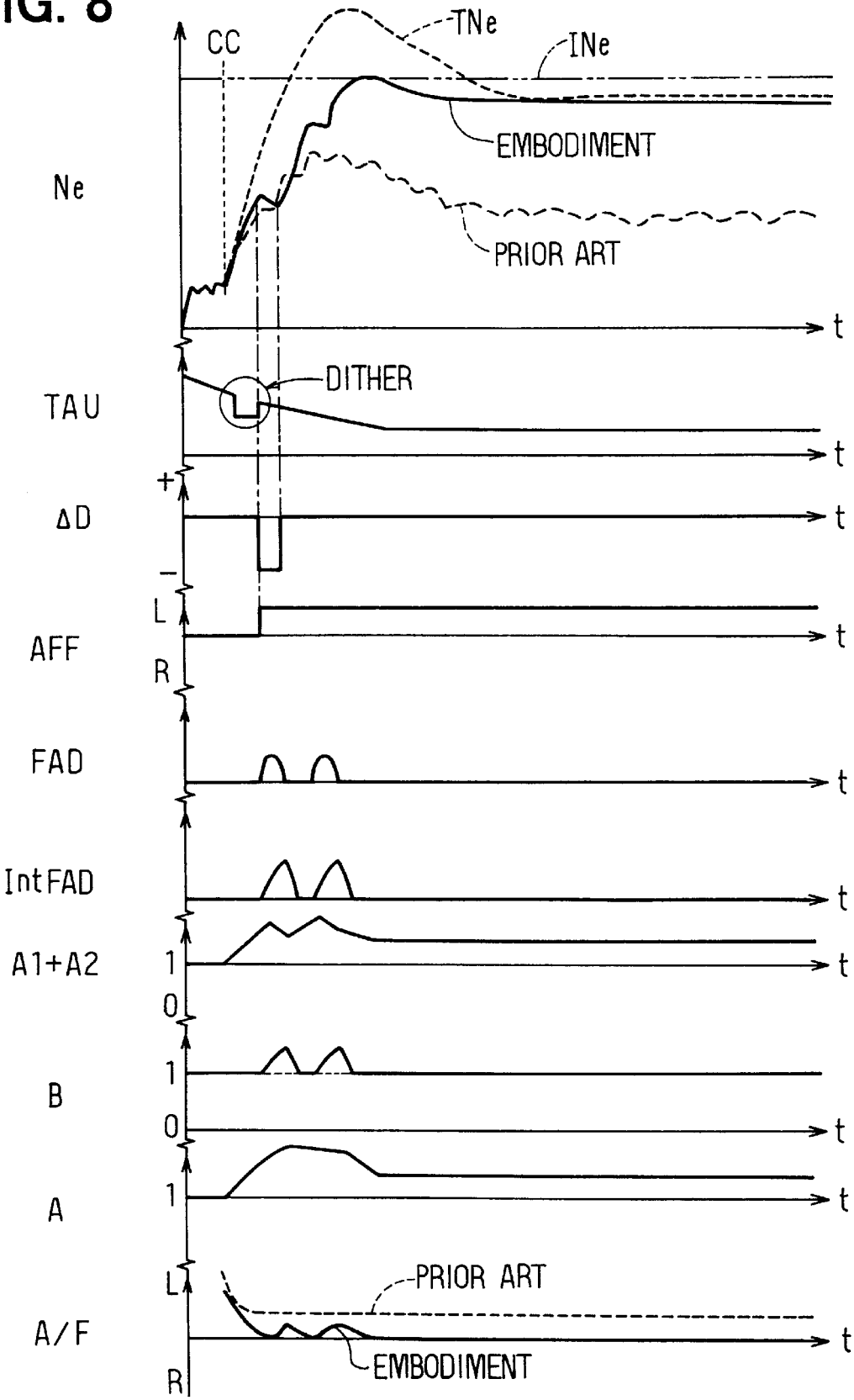
FIG. 8 is a timing diagram showing an operation of the air-fuel ratio control system when the air-fuel ratio immediately after the complete combustion is excessively lean and the engine rotation speed does not rise so high due to misfire.
Figure 9:
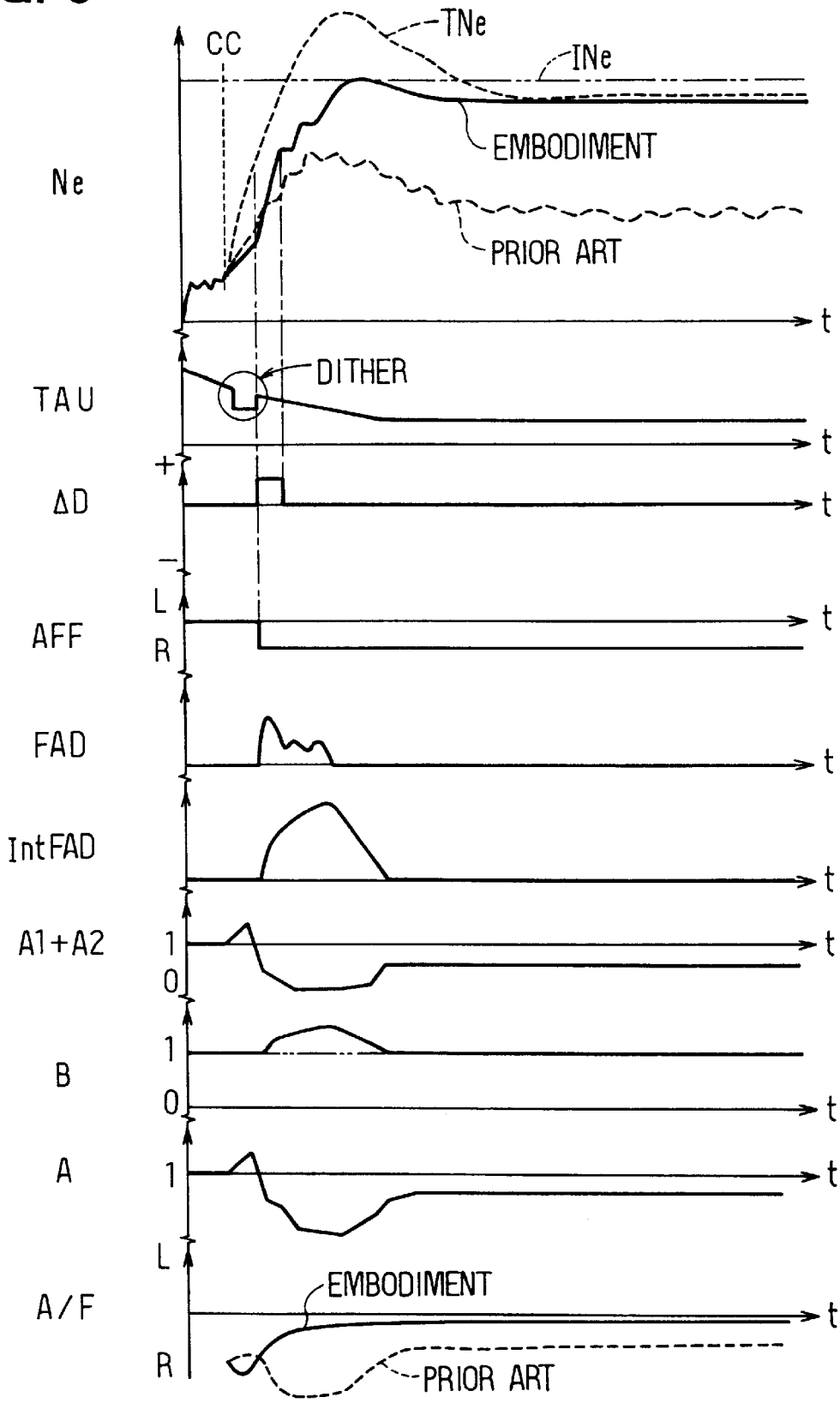
FIG. 9 is a timing diagram showing an operation of the air-fuel ratio control system when the air-fuel ratio immediately after the complete combustion is excessively rich and the engine rotation speed does not rise so high due to misfire.

If the check result at step 110 is NO (DFF=1 or Te<T), the MPU 28 does not execute the injection dither control of steps 111 to 115. If it is YES, on the other hand, the MPU 28 executes the injection dither control at step 111. In this dither control, the fuel injection amount is decreased than calculated for a predetermined period (one or a plurality of fuel injections) so that the air-fuel ratio of mixture is forced to be regulated to the leaner side. As shown in FIGS. 7 to 9, this dither control is attained after the complete combustion (CC) of mixture and during a period in which the engine rotation speed rises.

The MPU 28 then calculates at step 112 a deviation ΔD between the engine speeds Ne before and after the injection dither control as follows.

$$\Delta D=\{Ne(i)-Ne(i-1)\}-\{Ne(i-2)-Ne(i-3)\}$$

In the above calculation, Ne(i), Ne(i−1), Ne(i−2) and Ne(i−3) indicate the actual engine speeds detected presently, one injection before, two injections before and three injections before, respectively. Further, {Ne(i)−Ne(i−1)} indicates a difference in the rotation speeds caused by the injection dither control, and {Ne(i−2)−Ne(i−3)} indicates a difference in the rotation speeds before the injection dither control. This deviation ΔD is used as a parameter to evaluate changes in the engine speeds Ne caused by the injection dither control.

For instance, as shown in FIG. 7, when the air-fuel ratio (A/F) immediately after the complete combustion of mixture is rich and the engine speed Ne rises above the target speed TNe, the dither control to the leaner air-fuel ratio side only causes the engine speed Ne to rise slowly. However, as shown in FIG. 8, when the air-fuel ratio immediately after the complete combustion of mixture is excessively lean and the engine speed Ne does not rise due to misfire, the dither control causes a temporary fall of the engine speed Ne due to the far leaner air-fuel ratio. Further, as shown in FIG. 9, when the air-fuel ratio immediately after the complete combustion of mixture is excessively rich and the engine speed Ne does not rise due to misfire, the dither control causes a rapid rise of the engine speed Ne due to the optimized air-fuel ratio. From the above operation characteristics, the air-fuel ratio of mixture can be estimated.

Thus, the MPU 28 calculates at step 114 an estimated air-fuel ratio EAF of mixture supplied to the engine 11 based on the calculated deviation ΔD caused by the dither control. The MPU 28 then determines richness/leanness of mixture from the estimated air-fuel ratio EAF at step 114, and sets an air-fuel ratio flag AFF based on the determined richness/leanness. The injection dither execution flag DFF is set to 1 at step 115 to indicate the completed execution of the dither control.

The MPU 28 calculates at step 116 the first fuel injection correction value A1 based on the air-fuel ratio flag AFF and the difference ΔNe between the actual engine speed Ne and the target engine speed TNe. The first correction value A1 is set to increase a fuel decrement value as the speed difference ΔNe increases, when the air-fuel ratio flag AFF indicates rich mixture. The MPU 28 then calculates the second fuel injection correction value A2 at steps 117 to 120.

First, at step 117, an intake air amount Gnl per cylinder is calculated from the detection signal of the air flow meter 15, and an estimated speed change DNe of the engine speed is calculated from the calculated intake air amount Gnl. Alternatively, the estimated speed change DNe may be calculated from intake air pressures Pm or throttle angles TA. At step 118, an estimated engine speed MNe is calculated as follows by adding the estimated speed change DNe to the actual engine speed Ne as follows.

$$MNe=Ne+DNe$$

Then, at step 119, an estimated speed difference ΔMNe is calculated as follows from the estimated engine speed MNe and the target engine speed TNe.

$$\Delta MNe=MNe-TNe$$

Finally at step 120, the second fuel injection correction value A2 is calculated from the air-fuel ratio flag AFF and the estimated speed difference ΔMNe. In this instance, the second fuel injection correction value A2 is set to increase the fuel decrement value as the estimated speed difference ΔMNe increases, when the air-fuel ratio flag AFF indicates rich mixture.

The MPU 28 then calculates a fuel injection correction value B in correspondence with combustion unstableness value at steps 121 to 27. That is, at step 121, an average ΔDa of speed changes in a plurality of (e.g., six) successive mixture combustions is calculated as follows.

$$\Delta Da=[\{Ne(i)-Ne(i-1)\}+\{Ne(i-1)-Ne(i-2)\}+\ldots+\{Ne(i-5)-Ne(i-6)\}]/6$$

At step 122, a speed change ΔDtt in a specified combustion period (e.g., from three ignitions before to two ignitions before) of the plurality of combustion periods is calculated as follows.

$$\Delta Dtt=Ne(i-2)-Ne(i-3)$$

At step 123, as a combustion unstableness value FAD, an absolute value of a difference between the speed change ΔDtt in the specified combustion period and the average ΔDav of speed changes is calculated as follows.

$$FAD=|\Delta Dtt-\Delta Dav|$$

At step 124, the presently calculated combustion unstableness value FAD is added to a previous integrated value IntFAD(i−1) of the combustion unstableness value and a time attenuation value GFAD is subtracted, thus updating the integrated value IntFAD of the combustion unstableness value as follows.

$$IntFAD=IntFAD(i-1)+FAD-GFAD$$

The time attenuation value GFAD is for taking into consideration the time-dependent attenuation of the speed change. It is preferably determined as a function of the engine speed Ne and the intake air amount Gn.

At step 125, the integrated value IntFAD of combustion unstableness values FAD is compared with a reference REF which is determined as a reference of the engine speed Ne and the intake air amount Gn. If the comparison result is NO (IntFAD<REF), the mixture combustion condition is considered to be relatively stable and no fuel injection correction is necessitated. Therefore, at step 126, the fuel injection correction value B is set to 1 indicating no correction.

If the comparison result at step 125 is YES (IntFAD>REF), on the contrary, the mixture combustion condition is considered to be unstable fuel injection correction is necessitated. Therefore, at step 127, the fuel injection correction value B is calculated based on the integrated unstableness value IntFAD, the air-fuel ratio flag AFF and the speed difference ΔNe, thereby to compensate for the combustion unstableness.

Finally at step 128, the MPU 28 calculates the final fuel injection correction value A as follows from the first injection correction value A1 corresponding to the actual engine speed difference ΔNe, the second injection correction value A2 corresponding to the estimated speed change ΔMNe and the injection correction value B corresponding to the combustion unstableness.

$$A=(A1+A2)\times B$$

The final fuel injection amount TAU is thus determined by correcting the normal fuel injection amount with the above injection correction value, thereby regulating the engine speed Ne to the target engine speed TNe immediately after the complete combustion of mixture.

Figure 6:
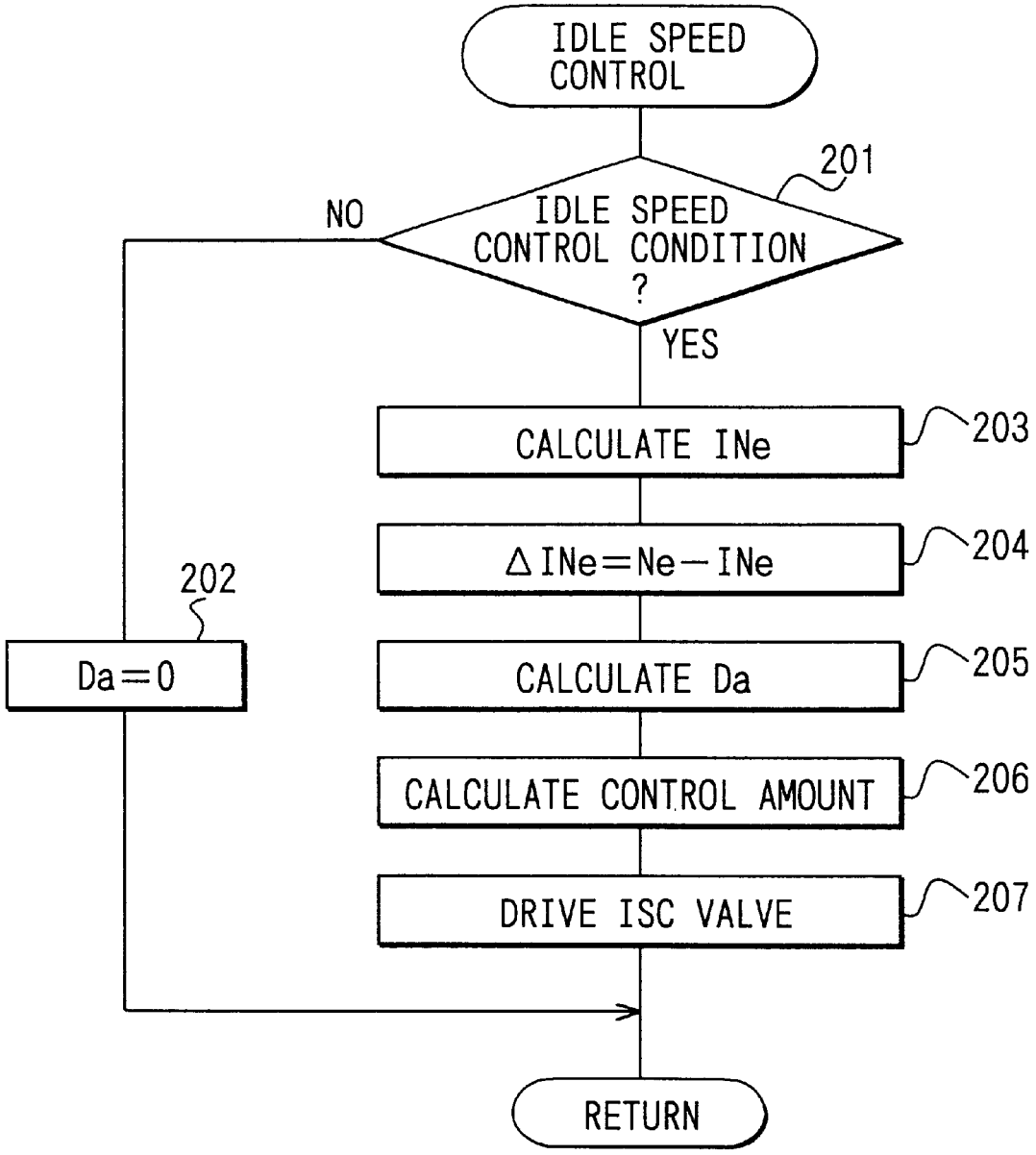
FIG. 6 is a flow diagram showing processing of an idle speed control program.

In addition to the above post-complete combustion air-fuel ratio control processing, the MPU 28 is further programmed to execute an idle speed control processing shown in FIG. 6. This processing is executed every predetermined time interval or predetermined crankshaft angular rotation.

The MPU 28 first checks at step 201 whether the engine is in a predetermined idle speed control condition. This control condition may include that the throttle valve 6 is fully closed, the vehicle speed is below a predetermined speed, and the like. If the check result is NO, the MPU 28 sets a bypass air correction value Da to 0, thus ending the processing. In this instance, the idle speed control is not effected and hence the bypass air amount is not corrected.

If the check result at step 201 is YES, the MPU 28 calculates at step 203 a target idle speed INe based on the coolant temperature THW, air conditioner load, torque converter load, electrical load and the like. The target idle speed INe is set to be higher than a value to which the target engine speed TNe converges in the post-complete combustion air-fuel ratio control operation. The MPU 28 then calculates at step 204 a difference ΔINe between the actual engine speed Ne and the target idle speed INe as follows.

$$\Delta INe=Ne-INe$$

The MPU 28 calculates at step 205 the bypass air correction amount Da based on the calculated idle speed difference ΔINe. The bypass air correction amount Da is increased as the speed difference ΔINe increases. The MPU 28 calculates at step 206 the control amount for the ISC valve 19 based on the bypass air correction value Da, and produces at step 207 a control signal to drive the ISC valve 19, that is, to regulate the opening angle of the ISC valve 19. Thus, as long as the engine 11 is in the idle speed control condition, the engine speed (idle speed) Ne is feedback-controlled to the target idle speed INe.

In the above operation of post-complete mixture combustion air-fuel ratio control and the idle speed control, both controls interfere each other if both control gains are equal, and may cause unstable or irregular engine rotations resulting in vibrations of the vehicle. It is preferred for this reason to set the control gain of the post-complete mixture combustion air-fuel ratio control to be larger than that of the idle speed control. Thus, the correction of the bypass air amount is made less influential on the engine speed than the correction of the fuel injection amount is. That is, the idle speed feedback control influences the engine speed less than the air-fuel ratio control immediately after the complete mixture combustion so that the engine speed does not change irregularly.

The operations of the present embodiment are summarized as follows with reference to FIGS. 7 to 9.

FIG. 7 shows a case in which the air-fuel ratio (A/F) of mixture supplied to the engine immediately after the complete combustion is rich (R) and the engine speed Ne rises high. According to the conventional control, the engine speed Ne rises to much higher than the target engine speed TNe and the air-fuel ratio remains rich for a long period of time. As a result, the fuel is consumed more immediately after the complete combustion and unburned exhaust emissions increase. According to the present embodiment, on the contrary, the air-fuel ratio (A/F) is corrected to the leaner side when the engine speed Ne rises above the target engine speed TNe due to rich air-fuel ratio. As a result, the fuel is consumed less and unburned exhaust emissions such as hydrocarbons (HC) are reduced.

FIG. 8 shows a case in which the air-fuel ratio (A/F) of mixture supplied to the engine immediately after the complete combustion is too lean (L) and the engine speed Ne does not rise high due to misfire. According to the conventional control, the engine speed Ne remains much lower then the target engine speed TNe because of misfire and the engine rotation remains unstable. The misfire further generates unburned exhaust emissions. According to the present embodiment, on the contrary, the air-fuel ratio (A/F) is corrected to the richer side. As a result, the air-fuel ratio is maintained at the appropriate ratio to prevent misfire and reduce the unburned exhaust emissions. Further, the engine speed Ne rises toward the target engine speed TNe, thus reducing vibrations in the vehicle.

FIG. 9 shows a case in which the air-fuel ratio (A/F) of mixture supplied to the engine immediately after the complete combustion is too rich (R) and the engine speed Ne does not rise high due to misfire. According to the conventional control, the engine speed Ne remains much lower then the target engine speed TNe because of misfire and the engine rotation remains unstable. The misfire further generates unburned exhaust emissions. According to the present embodiment, on the contrary, the air-fuel ratio (A/F) is corrected to the leaner side. As a result, the air-fuel ratio is maintained at the appropriate ratio to prevent misfire and reduce the unburned exhaust emissions. Further, the engine speed Ne rises toward the target engine speed TNe, thus reducing vibrations in the vehicle.

As described above, according to the present embodiment, the air-fuel ratio of mixture supplied to the engine is controlled so that the engine speed Ne immediately after the complete mixture combustion converges to the target engine speed TNe. As a result, the air-fuel ratio can be controlled appropriately immediately after the complete mixture combustion in the engine, even when the air-fuel ratio sensor is inoperative (not activated) due to low temperature or the engine speed changes unstably. Thus, the exhaust emissions can be reduced and misfire as well as engine stall can be prevented, immediately after starting engine cranking.

The target engine speed TNe is determined based on the coolant temperature THW at the time of starting engine cranking. As a result, the target engine speed TNe can be set appropriately in consideration of the stability of engine rotation and rise of engine speed. Further, post-engine starting idle rotation characteristics can be ensured without being influenced by engine temperatures.

The air-fuel ratio of mixture supplied to the engine is subjected to the dither control which reduces fuel supply for a moment at a predetermined time after the complete combustion of mixture. The richness/leanness of the air-fuel ratio of mixture supplied to the engine is determined based on the deviation ΔD in engine speed differences detected before and after the dither control. It can be detected whether the misfire is caused because of excessive richness or excessive leanness of the air-fuel ratio, when the misfire occurs and the engine speed does not rise sufficiently.

Further, the estimated change DNe of the engine speed is estimated based on engine loads, and added to the current engine speed Ne to estimate the next engine speed MNe. The fuel injection correction value A2 is determined based on the estimated engine speed change ΔMNe between the estimated engine speed MNe and the target engine speed TNe. As a result, the air-fuel ratio can be corrected by estimating the engine speed change before the engine speed actually changes, and the engine speed can be controlled to converge to the target engine speed TNe in a shortest possible time.

The combustion unstableness value FAD is determined based on the engine speed change, and the integrated value IntFAD of this unstableness value FAD is used to detect the misfire level. Thus, the fuel injection correction value B can be set to prevent misfire based on this integrated value IntFAD.

The fuel injection correction value A is changed gradually to no correction value, when the throttle valve is opened or the normal air-fuel ratio feedback control using the air-fuel ratio sensor is started in the course of the post-complete combustion air-fuel ratio control. As a result, the air-fuel ratio of mixture does not change drastically and torque shock can be minimized.

The target engine speed TNe in the post-complete combustion air-fuel ratio control is set to converge to be lower than the target idle speed INe in the idle speed control. As a result, the post-complete combustion air-fuel ratio control can be effected to predominate over the idle speed control, even after the engine speed Ne reaches the target idle speed in the idle speed control. Thus, the air-fuel ratio of mixture can be regulated to the lean side as much as possible.

The present embodiment may be modified in various ways. For instance, a target engine torque characteristics may be set in place of the target engine speed characteristics, and the air-fuel ratio of mixture may be controlled so that an actual engine torque immediately after the complete mixture combustion follows the target engine torque characteristics. The air-fuel ratio of mixture may be corrected by controlling fuel evaporation gas purged from a canister into the intake pipe in place of correcting the fuel injection amount. The idle speed control may be effected by regulating the opening angle of the throttle valve in place of regulating the bypass ISC valve. Further, only some of the correction values A1, A2 and B may be used for the fuel injection correction, and the combustion unstableness value FAD may be calculated in a different manner.

What is claimed is:

1. An air-fuel ratio control apparatus for internal combustion engines comprising:

target characteristics setting means for setting target operation characteristics of a predetermined engine speed parameter which should occur after a complete combustion of air-fuel mixture supplied to an engine, the predetermined engine speed parameter being indicative of an engine rotation speed; and air-fuel ratio control means for comparing actual operation characteristics of the predetermined engine speed parameter with the target operation characteristics, and controlling an air-fuel ratio of the air-fuel mixture based on a comparison result so that the actual operation characteristics follow the target operation characteristics, said controlling of the air-fuel ratio of the air-fuel mixture based on the comparison result being started after the complete combustion of the air-fuel mixture.

2. An air-fuel ratio control apparatus as in claim 1, wherein:

the target characteristics setting means sets the target operation characteristics based on at least a coolant temperature of the engine at the time of starting an engine cranking.

3. An air-fuel ratio control apparatus as in claim 1, further comprising:

unstableness calculation means for calculating a combustion unstableness value based on changes in the predetermined engine speed parameter, wherein the air-fuel ratio control means corrects a control amount of the air-fuel ratio based on the calculated combustion unstableness value.

4. An air-fuel ratio control apparatus as in claim 3, wherein:

the unstableness calculation means calculates the combustion unstableness value by comparing an average of changes in the predetermined engine speed parameter in a plurality of combustion periods with a change in the predetermined engine speed parameter in a specified combustion period in the plurality of combustion periods.

5. An air-fuel ratio control apparatus as in claim 1, further comprising:

parameter estimation means for estimating next engine speed parameter based on a preset engine speed parameter and an estimated change of the engine speed parameter estimated from a load condition of the engine, wherein the air-fuel ratio control means controls the air-fuel ratio of air-fuel mixture by comparing the estimated engine speed parameter with the target operation characteristics.

6. An air-fuel ratio control apparatus as in claim 1, further comprising:

an air-fuel ratio sensor for detecting an actual air-fuel ratio of air-fuel mixture supplied to the engine;

feedback control means for feedback-controlling the air-fuel ratio of air-fuel mixture in response to the detected actual air-fuel ratio sensor, wherein the air-fuel ratio control means gradually reduces a correction amount for a control amount of its air-fuel ratio control responsive to the comparison result so that the air-fuel ratio control is disabled, when the feedback control means starts its air-fuel ratio feedback control or a throttle valve is opened.

7. An air-fuel ratio control apparatus as in claim 1, further comprising:

idle speed control means for controlling an intake air amount during an engine idle condition so that the engine speed is feedback-controlled to a target idle speed, wherein the target characteristics setting means sets a target engine speed to which the target operation characteristics converges to be lower than the target idle speed.

8. An air-fuel ratio control apparatus as in claim 1, wherein:

the air-fuel ratio control means has a control gain larger than that of the idle speed control means.

9. An air-fuel ratio control apparatus as in claim 1, wherein:

the complete combustion of air-fuel mixture is detected when the engine speed rises to a predetermined speed lower than a target idle speed of an idle speed feedback control.

10. An air-fuel ratio control apparatus for internal combustion engines comprising:

target characteristics setting means for setting target operation characteristics of a predetermined engine speed parameter which should occur after a complete combustion of air-fuel mixture supplied to an engine, the predetermined engine speed parameter being indicative of an engine rotation speed;

air-fuel ratio control means for comparing actual operation characteristics of the predetermined engine speed parameter with the target operation characteristics, and controlling an air-fuel ratio of the air-fuel mixture based on a comparison result so that the actual operation characteristics follow the target operation characteristics, said controlling of the air-fuel ratio of the air-fuel mixture based on the comparison result being started after the complete combustion of the air-fuel mixture;

dither control means for effecting a fuel injection dither control at a predetermined time after the complete combustion of air-fuel mixture, the dither control being for temporarily changing the air-fuel ratio of air-fuel mixture;

air-fuel ratio determination means for determining richness/leanness of the air-fuel ratio of air-fuel mixture based on changes in the predetermined engine speed parameter caused by the dither control; and wherein the air-fuel ratio control means corrects a control amount of the air-fuel ratio based on the determined richness/leanness of the air-fuel ratio.

11. An air-fuel ratio control method for engines comprising:

starting cranking an engine by supplying air-fuel mixture to the engine;

detecting a complete combustion of the air-fuel mixture in the engine;

setting a target engine speed after a detection of the complete combustion, the target engine speed being varied to rise above an engine idle speed after the complete combustion and then fall toward the engine idle speed as time elapses;

comparing an actual engine speed with the target engine speed; and correcting the air-fuel ratio of air-fuel mixture supplied to the engine based on a comparison result of the comparing step so that the actual engine speed follows the target engine speed, the correcting of the air-fuel ratio based on the comparison result being started after complete combustion of the air-fuel mixture.

12. An air-fuel ratio control method as in claim 11, wherein:

the target engine speed is set to vary with an engine temperature at the time of starting cranking the engine.

13. An air-fuel ratio control method as in claim 11, wherein:

the target engine speed is set to fall below the engine idle speed after rising.

14. An air-fuel ratio control method as in claim 11, wherein:

the complete combustion is detected when the actual engine speed rises above a predetermined speed lower than the engine idle speed.

15. An air-fuel ratio control method as in claim 11, further comprising:

disabling the correcting step when a throttle valve of the engine is opened from its closed position; and disabling the correcting step when an air-fuel ratio sensor disposed in an exhaust of the engine becomes operative to enable an air-fuel ratio feedback control responsive to an output of the air-fuel ratio sensor.

16. An air-fuel ratio control method as in claim 11, wherein said target engine speed is set immediately after the detection of the complete combustion.

17. An air-fuel ratio control method for engines comprising:

starting cranking an engine by supplying air-fuel mixture to the engine;

detecting a complete combustion of the air-fuel mixture in the engine;

setting a target engine speed after a detection of the complete combustion, the target engine speed being varied to rise above an engine idle speed after the complete combustion and then fall toward the engine idle speed as time elapses;

comparing an actual engine speed with the target engine speed;

correcting the air-fuel ratio of air-fuel mixture supplied to the engine based on a comparison result of the comparing step so that the actual engine speed follows the target engine speed, the correcting of the air-fuel ratio based on the comparison result being started after complete combustion of the air-fuel mixture;

changing the air-fuel ratio of air fuel mixture temporarily to a leaner ratio after the complete combustion while the actual engine speed is rising;

detecting changes in the actual engine speeds before and after the changing step; and correcting the air-fuel ratio of air-fuel mixture further based on the detected changes in the actual engine speeds.

18. An air-fuel ratio control apparatus for internal combustion engines comprising:

a target characteristics setter for setting target operation characteristics of a predetermined engine speed parameter which should occur after a complete combustion of air-fuel mixture supplied to an engine, the predetermined engine speed parameter being indicative of an engine rotation speed; and an air-fuel ratio controller for comparing actual operation characteristics of the predetermined engine speed parameter with the target operation characteristics, and controlling an air-fuel mixture based on a comparison result so that the actual operation characteristics follow the target operation characteristics, said controlling of the air-fuel ratio of the air-fuel mixture based on the comparison result being started after the complete combustion of the air-fuel mixture.

19. An air-fuel ratio control apparatus as in claim 18, wherein:

the target characteristics setter sets the target operation characteristics based on at least a coolant temperature of the engine at the time of starting an engine cranking.

20. An air-fuel ratio control apparatus as in claim 18, further comprising:

an unstableness calculator for calculating a combustion unstableness value based on changes in the predetermined engine speed parameter, wherein the air-fuel ratio controller corrects a control amount of the air-fuel ratio based on the calculated combustion unstableness value.

21. An air-fuel ratio control apparatus as in claim 20, wherein:

the unstableness calculator calculates the combustion unstableness value by comparing an average of changes in the predetermined engine speed parameter in a plurality of combustion periods with a change in the predetermined engine speed parameter in a specified combustion period in the plurality of combustion periods.

22. An air-fuel ratio control apparatus as in claim 18, further comprising:

a parameter estimator for estimating next engine speed parameter based on a preset engine speed parameter and an estimated change of the engine speed parameter estimated from a load condition of the engine, wherein the air-fuel ratio controller controls the air-fuel ratio of air-fuel mixture by comparing the estimated engine speed parameter with the target operation characteristics.

23. An air-fuel ratio control apparatus as in claim 18, further comprising:

an air-fuel ratio sensor for detecting an actual air-fuel ratio of the air-fuel mixture supplied to the engine;

a feedback controller for feedback-controlling the air-fuel ratio of air-fuel mixture in response to the detected actual air-fuel ratio sensor, wherein the air-fuel ratio controller gradually reduces a correction amount for a control amount of its air-fuel ratio control responsive to the comparison result so that the air-fuel ratio control is disabled, when the feedback controller starts its air-fuel ratio feedback control or a throttle valve is opened.

24. An air-fuel ratio control apparatus as in claim 18, further comprising:

an idle speed controller for controlling an intake air amount during an engine idle condition so that the engine speed is feedback-controlled to a target idle speed, wherein the target characteristics setter sets a target engine speed to which the target operation characteristics converges to be lower than the target idle speed.

25. An air-fuel ratio control apparatus as in claim 18, wherein:

the air-fuel ratio controller has a control gain larger than that of the idle speed controller.

26. An air-fuel ratio control apparatus as in claim 18, wherein:

the complete combustion of air-fuel mixture is detected when the engine speed rises to a predetermined speed lower than a target idle speed of an idle speed feedback control.

27. An air-fuel ratio control apparatus for internal combustion engines comprising:

a target characteristics setter for setting target operation characteristics of a predetermined engine speed parameter which should occur after a complete combustion of air-fuel mixture supplied to an engine, the predetermined engine speed parameter being indicative of an engine rotation speed;

an air-fuel ratio controller for comparing actual operation characteristics of the predetermined engine speed parameter with the target operation characteristics, and controlling an air-fuel mixture based on a comparison result so that the actual operation characteristics follow the target operation characteristics, said controlling of the air-fuel ratio of the air-fuel mixture based on the comparison result being started after the complete combustion of the air-fuel mixture;

a dither controller for effecting a fuel injection dither control at a predetermined time after the complete combustion of air-fuel mixture, the dither control being for temporarily changing the air-fuel ratio of air-fuel mixture;

an air-fuel ratio determiner that determines richness/leanness of the air-fuel ratio of air-fuel mixture based on changes in the predetermined engine speed parameter caused by the dither control; and wherein the air-fuel ratio controller corrects a control amount of the air-fuel ratio based on the determined richness/leanness of the air-fuel ratio.

* * * * *